US006543541B2

(12) United States Patent
Buyers et al.

(10) Patent No.: US 6,543,541 B2
(45) Date of Patent: Apr. 8, 2003

(54) ACCESS CONTROL BETWEEN A MAIN BORE AND A LATERAL BORE IN A PRODUCTION SYSTEM

(75) Inventors: Mark Buyers, Dyce (GB); David Forsythe, Dyce (GB)

(73) Assignee: Omega Completion Technology Limited, Aberdeen (GB)

( * ) Notice: Subject to any disclaimer, the term of this patent is extended or adjusted under 35 U.S.C. 154(b) by 0 days.

(21) Appl. No.: 09/777,154

(22) Filed: Feb. 5, 2001

(65) Prior Publication Data

US 2002/0104659 A1 Aug. 8, 2002

(51) Int. Cl.[7] ..... E21B 43/12; E21B 43/14

(52) U.S. Cl. ..... 166/313; 166/50; 166/386; 166/373; 166/117.6; 166/242.5

(58) Field of Search ..... 166/386, 244.1, 166/305.1, 306, 313, 369, 373, 50, 117.5, 117.6, 242.5

(56) References Cited

U.S. PATENT DOCUMENTS 5,918,669 A * 7/1999 Morris et al.
6,237,683 B1 * 5/2001 Pringle et al.
6,308,783 B2 * 10/2001 Pringle et al.

FOREIGN PATENT DOCUMENTS

| | | | |
|---|---|---|---|
| EP | 900915 | | 3/1999 |
| GB | 2359574 | * | 8/2001 |
| WO | WO 97/12112 | | 4/1997 |

* cited by examiner

*Primary Examiner*—Roger Schoeppel
(74) *Attorney, Agent, or Firm*—Madson & Metcalf

(57) ABSTRACT

A method for controlling entry from a main bore of a casing into a lateral bore of a producing well which incorporates (i) means for surface-actuated flow control in the lateral bore (ii) a flow control means located in the casing adjacent to the lateral bore, and said method comprising the steps of:

a) removing the flow control means when entry to the lateral bore is required, said flow control means having an internal passage allowing upward flow of produced fluid from the main bore and through said passage;

b) mounting a locating nipple on the casing adjacent to the lateral bore;

c) engaging the flow control means with the nipple to locate the flow control means in the casing; and d) providing diverter means in the casing which engages with and is orientable relative to the nipple and operates to guide entry to the lateral bore from above the nipple following removal of said flow control means.

5 Claims, 7 Drawing Sheets

ACCESS CONTROL BETWEEN A MAIN BORE AND A LATERAL BORE IN A PRODUCTION SYSTEM

This invention is concerned generally with flow control in a lateral re-entry system between a main bore and a lateral bore in a production system.

In the oil and gas industries many types of well or borehole exist. Many are vertical shafts which pierce the earth and rock to a depth of thousands of feet. Where the wellbore penetrates an oil or hydrocarbon bearing rock strata, the hydrocarbons may be produced to surface. It is common for many layers of hydrocarbons to be present at varying depths, often isolated from each other by layers of impermeable rock.

Recent developments in technology have allowed drillers to deviate wells from the vertical in order to reach a target which may be distant from the wellsite or may allow complete drainage of a pool or field of hydrocarbons by using many wells from one central point. More recently, it has been possible to drill "horizonal" wells by deviating out by up to 90 degrees from the bottom of a vertical shaft. This technique may increase productivity by allowing access to a greater section of the rock strata than would have otherwise been possible in the vertical plane. This is advantageous when only a limited vertical footage of hydrocarbon bearing rock is present.

More recently, it has been possible to drill what is termed a "lateral" extension from a vertical well effectively allowing the construction of two wells with the saving of the cost of the vertical section of one. An.example of this is shown in FIG. 1 of the accompanying drawings. Following this theme, two or more laterals may be drilled with similar savings. The laterals may be highly deviated or horizontal in order to specifically target the hydrocarbons and provide optimal recovery of hydrocarbons from the well.

Following the drilling phase, multilateral wells are completed with pressure containing tubing in order to allow safe production of hydrocarbons to surface. At the junction of the laterals, packers provide a pressure isolation barrier between the lateral and the main bore. Devices may be installed at this point to regulate or shut off flow from the lateral. These devices are situated in the "trunk" or main bore section and are presently only recoverable by removing all the pressure containing tubing, packers and associated equipment collectively called the "completion". This is an obvious disadvantage if remedial work or investigation of any kind is required in the lateral as a drilling rig and crew will be required to remove the completion. This is a very costly operation and may be required during the lifetime of the well for a number of reasons. Also, for safety reasons, the well will have to be "killed" by filling with mud and pumping mud around the wellbore before the completion can be removed. This process may damage the oil bearing formations and reduce future recovery.

Remedial work and/or investigation will be required if there is water production. Should one lateral begin producing large amounts of water, not only will the produced water have to be processed on surface, but the water will displace oil which might otherwise have been produced. The water will also reduce the overall efficiency of the well. In this situation it is normal to plug or close off the area which is producing the water. This may entail plugging off the end section of a lateral.

The invention has therefore been developed primarily, though not exclusively, with a view to provide a method which may obviate these disadvantages by providing a means to re-enter a producing lateral in order to measure and deal with water production without killing the well and without removing the completion but also to provide separate remote control of the lateral when in its normal producing mode.

Preferred embodiments of lateral entry methods, for use in a method and system according to the invention for use with pressure bearing tubing in situ and surface operated flow control will be described in detail, by way of example, with reference to the accompanying drawings in which.

The preferred embodiments which will be described in detail herein, with reference to FIGS. 2 to 5 of the accompanying drawings, illustrate a method, and a system for carrying out the method, in controlling entry from a main bore of a casing into a lateral bore of a producing well which incorporates means for surface-actuated flow control in the lateral bore.

In general terms, the system includes the following functional components:

a) a flow control means which can be removed when entry to the lateral bore is required, such flow control means having an internal passage allowing upward flow of produced fluid from the main bore and through the passage;

b) a locating nipple adapted to be mounted on the casing adjacent to the lateral bore, said nipple engaging with the flow control means to located the latter in the casing when the flow control means is located in the well; and c) diverter means engageable with, and orientable relative to the nipple and operative to guide entry to the lateral bore from above the nipple following removal of the flow control means.

Figure 1:
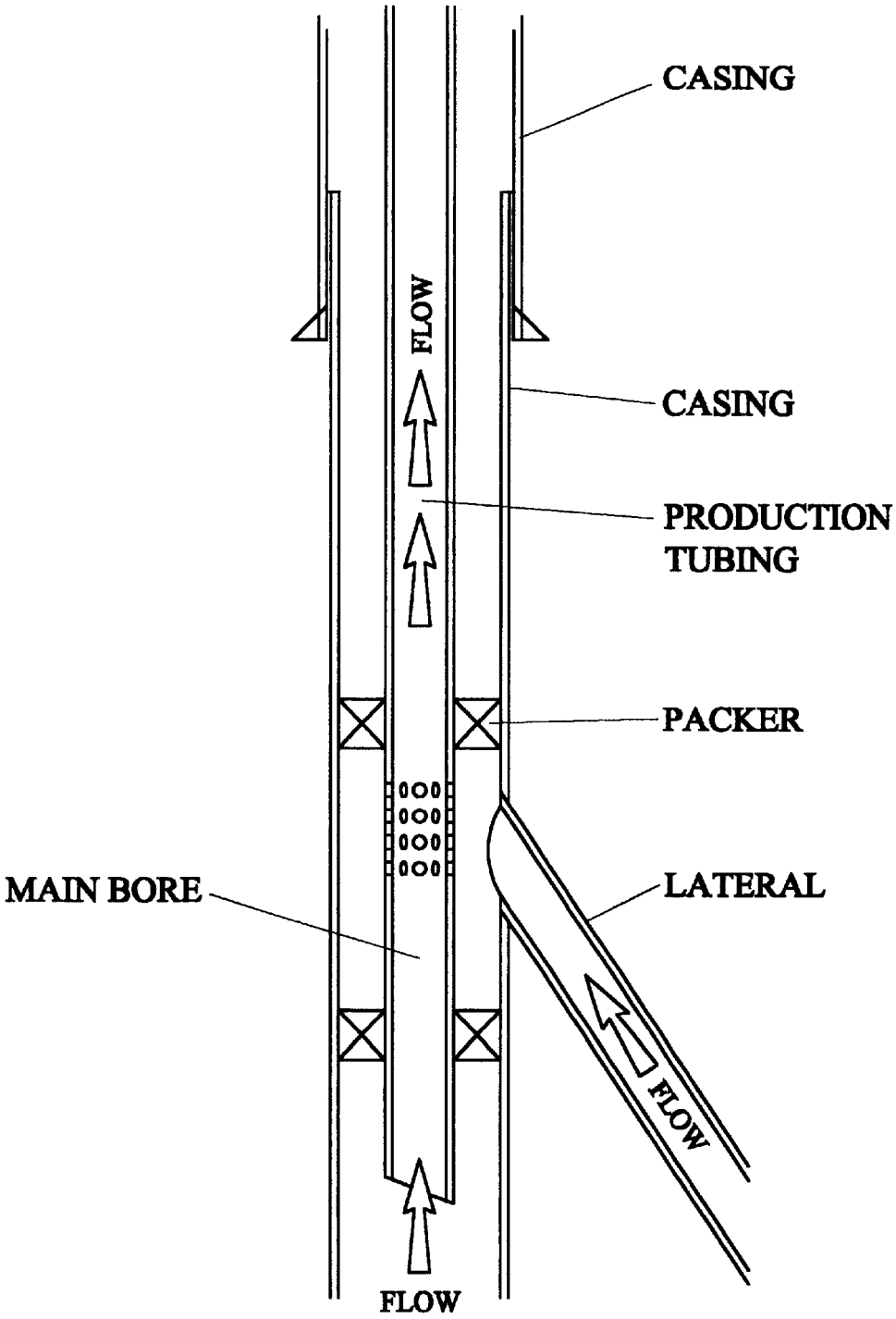
FIG. 1 is a schematic illustration of a typical multilateral well junction installation to which the invention may be applied, showing flow from the main bore and the lateral combining at the junction.
Figure 2:
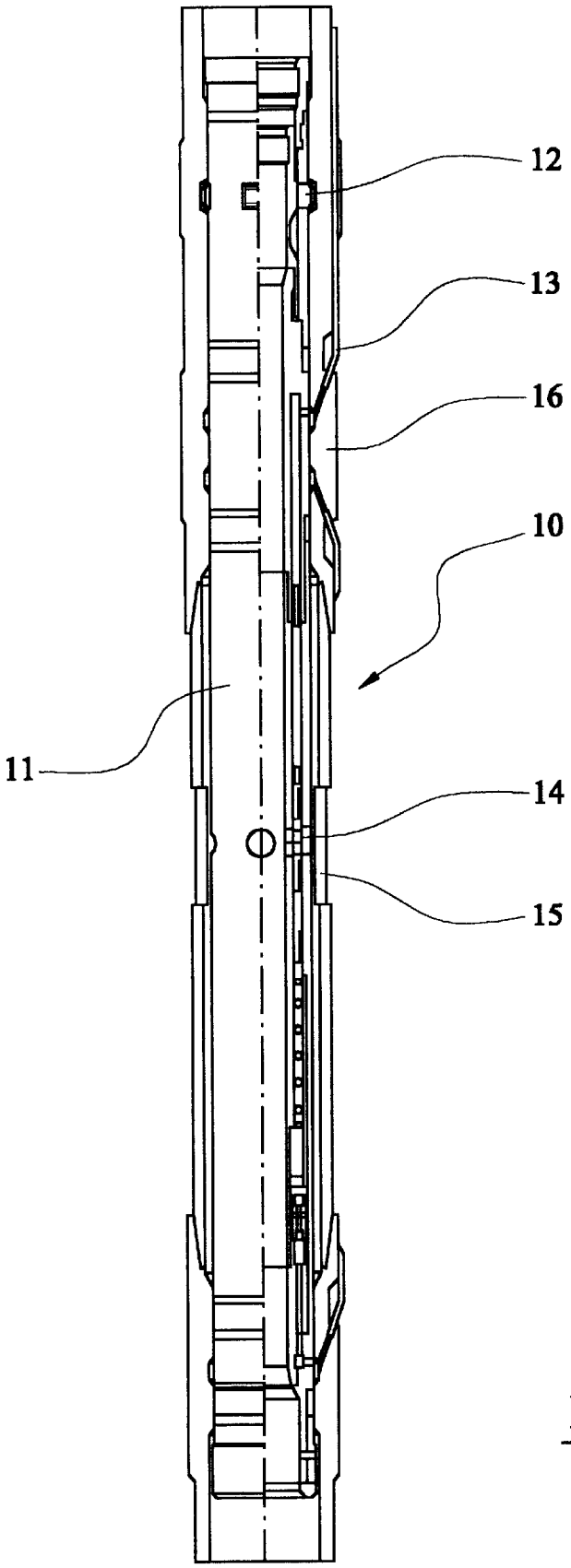
FIG. 2 shows a detail enlarged view of a wireline retrievable control valve shown inside a control valve nipple, for use in the installation.

Referring now to FIG. 2 of the drawings, there is shown utilisation of a production optimization tool (forming a removable flow control means), of the type disclosed in more detail in publication No. GB 2342665, and which is designated generally by reference 10. This tool is shown installed in a "nipple" of the system, and is a hydraulically operated flow control device, which is wireline retrievable.

The tool may be lowered from the surface so as to come into engagement with the nipple. Alternatively the tool may be located in the casing, in engagement with the nipple, before the casing is lowered down the well.

FIG. 2 shows a wireline retrievable insert 11, a lock mechanism 12, a hydraulic control line 13 to control the operation of the tool, and insert flow ports (14) (forming a choke), and nipple flow ports 15 (taking the form of slots) 15. The tool also has associated therewith a nipple 16, which is utilised during the location of the tool adjacent to the lateral bore when entry is required. Instead of hydraulic control, this may be carried out by other means, such as electronic or fibre optics.

Figure 3:
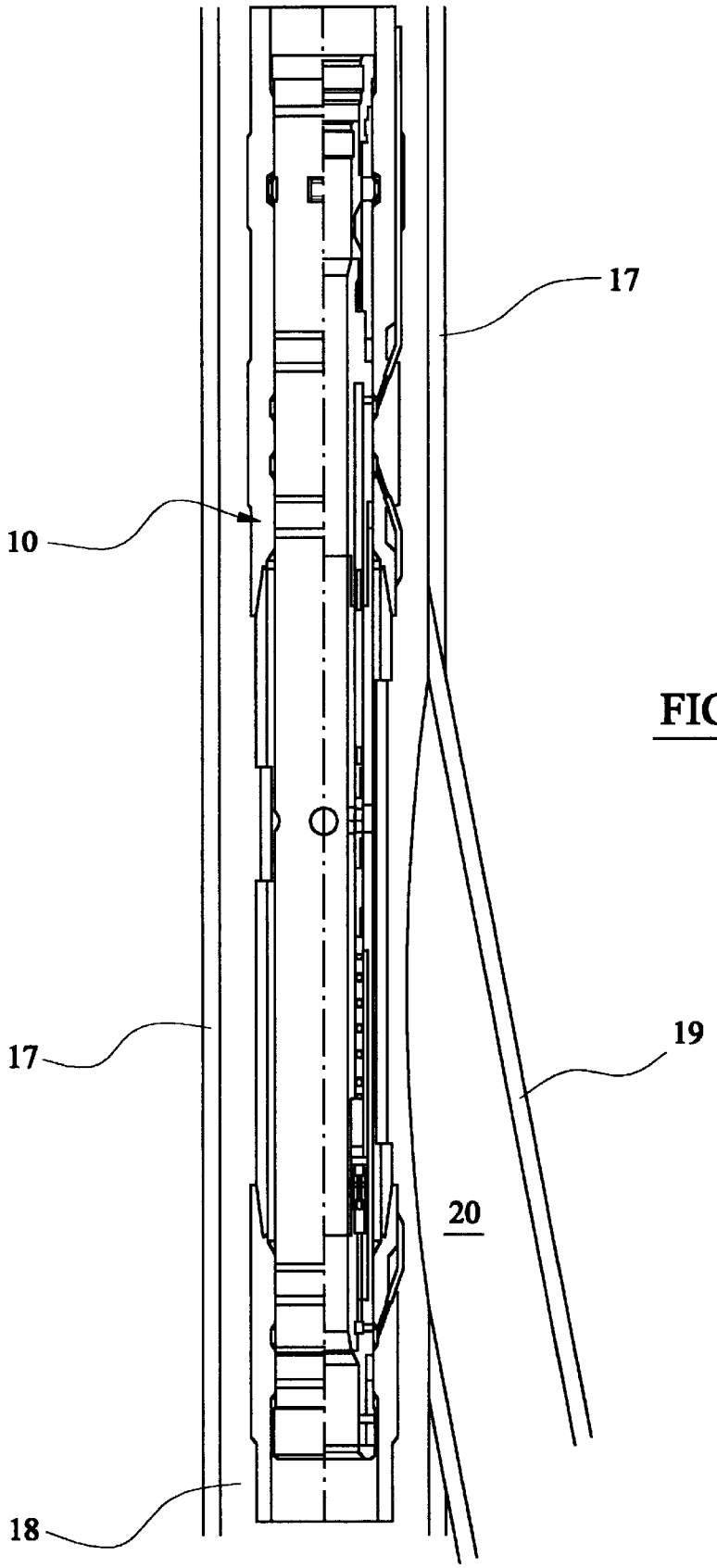
FIG. 3 shows a control valve installed in a modified control valve nipple having a large exit window and installed at the junction of a lateral and for use in a method and system according to the invention.

FIG. 3 shows the lowering of the tool 10 down a well casing 17, and which runs into a main bore 18 (for upward flow of produced fluids), and there is also shown a lateral casing 19 branching off the main bore 18.

FIG. 3 shows the tool 10 installed in the nipple 16, and fitted with a large exit window adjacent to the lateral bore 20 of the lateral casing 19.

Figure 4:
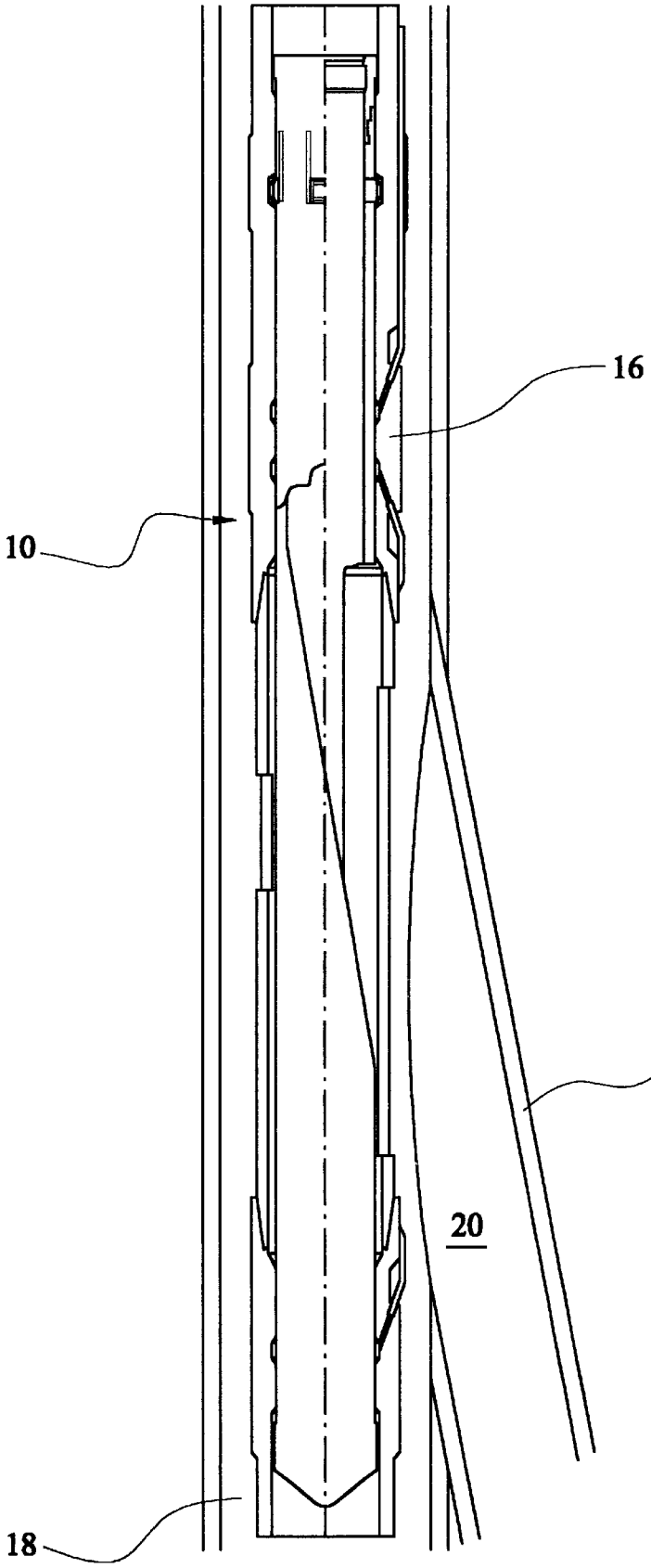
FIG. 4 shows the same nipple but with the control valve removed and a re-entry guide installed.

FIG. 4 shows the tool 10 located adjacent to lateral bore 20, and shows cooperation with nipple 16 with the flow control insert removed, and a "whipstock" deflector installed in its place.

Figure 5:
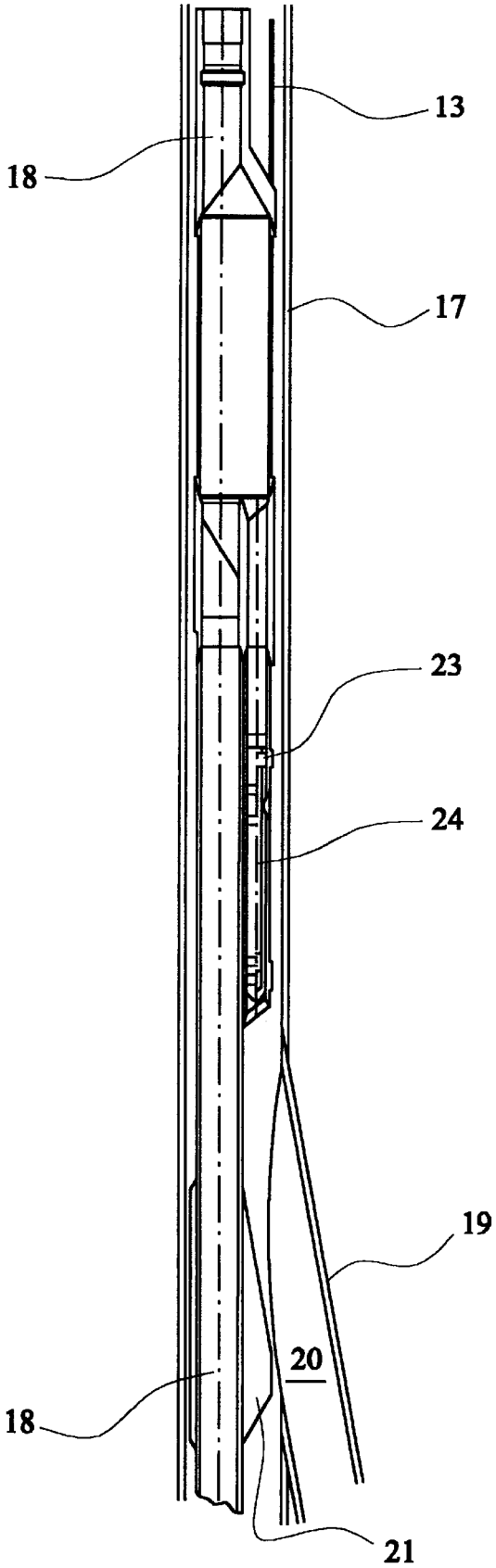
FIG. 5 shows another embodiment of the invention with a wireline retrievable control valve installed in a Y block control valve nipple.

FIG. 5 illustrates a preferred alternative arrangement, and shows a flow control valve in situ. The well casing 17 defines a main bore 18, which conveys produced fluids upwardly to surface, and shows, adjacent to the lateral bore 20, a permanently installed deflector 21.

FIG. 5 also shows a locking means 22 for a temporary diverter, a hydraulic control line 13, and a lock mechanism 23 forming part of the flow control tool. The tool also incorporates flow ports 24.

Figure 6:
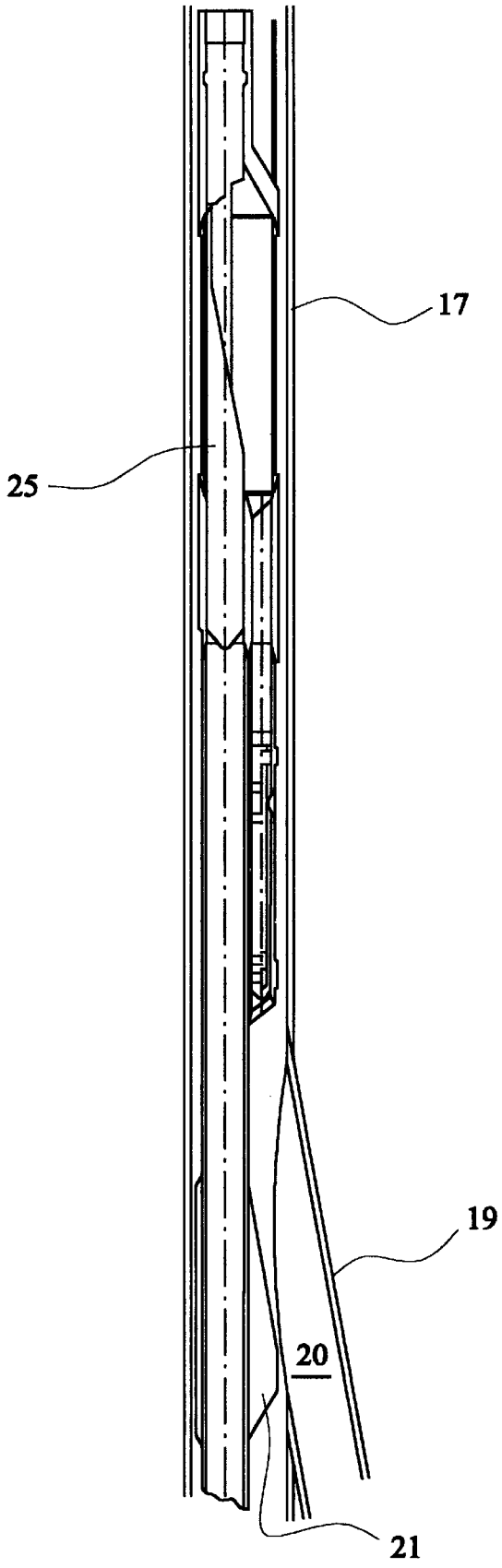
FIG. 6 shows the same nipple but with the re-entry guide installed to direct wireline latching tools onto the flow control valve.

FIG. 6 shows a further alternative arrangement, and shows a temporary diverter 25 installed in position.

Figure 7:
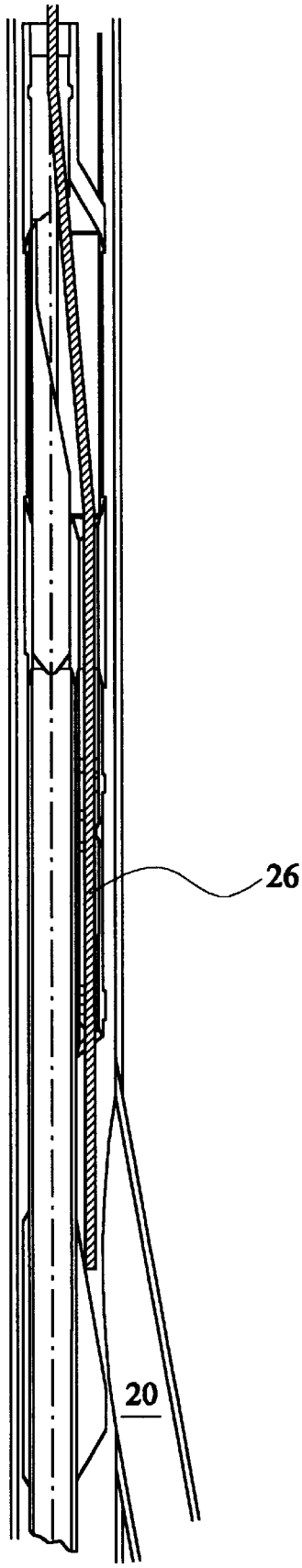
FIG. 7 shows the same nipple with the flow control valve removed and with a wireline toolstring being lowered into the wellbore and directed into the lateral.

Finally, FIG. 7 shows the position taken up by the component parts after the flow control valve has been removed, and wireline tools, designated generally by reference 26, are shown introduced into the lateral bore 20.

The disclosure in publication No. GB 2342665 is of a production optimisation tool, and the disclosure of which is intended to be incorporated herein by this reference.

This document teaches the provision of a valve device which is used to selectively control or close off flow from a producing formation or lateral. The device is available in two formats, tubing retrievable and wireline retrievable. As previously discussed above, as the tubing retrievable item is an integral part of the completion, its removal or recovery is dependent on the well being killed and the completion being pulled by a drilling rig. The wireline retrievable item may however be removed by a technique termed "wireline". Wireline operations are inexpensive and are performed by a crew normally of two operators. They operate a winch unit featuring a drum which is spooled with piano style wire, normally 0.108" diameter- Production is halted whilst tools are lowered into the well on this wire. Surface equipment is designed to contain the pressure and allow introduction/removal of many different tools to the wellbore. The interruption to production is significantly less than for an open hole intervention (kill the well and pulling the completion with a drilling rig). A pulling tool may be run to latch the central core or insert of the Wireline Retrievable Control Valve (see FIG. 2). The WRCV insert may then be removed from its nipple (which is permanently installed as part of the completion) to provide a slick bore allowing a large diameter passage to other devices installed in the wellbore below. (See FIG. 3). When the WRCV is replaced, an orientation key (locator plate) situated on the nipple engages with an upset on the WRCV causing the flowports of the WRCV to align with those of the nipple. As can be seen, use of this device allows flow control of a lateral bore with large diameter access to below possible upon removal. The outer nipple in this application has slots cut in the body to allow flow from the lateral to enter. These slots are not large enough to allow entry to the lateral and also may not coincide with the lateral opening.

The method of construction of a lateral will now be discussed with particular attention being given to the orientation of the lateral. The first step in the construction of a lateral is to drill the main well or trunk. When this has been completed, a permanent packer is set approximately 30 ft below the intended location of the lateral. An example of the packer type is the Baker Oil Tools ML TorqueMaster™. This packer provides a seat for the introduction of various equipment but, most importantly includes an orientation key. The packer is now a permanent feature of the well and will not rotate. It also features a large through bore allowing access and production from below. After installing the packer, a survey tool is lowered into the well and engaged with the orientation key. The survey tool will record the exact bearing of the key (e.g. 50 degrees north). Following removal of the survey tool a whipstock tool is assembled and a set orientation locked into it such that when it is engaged with the key in the packer, the whipstock will point in the required direction for the lateral. For example, assume the packer key is pointing 50 degree north. If the desired direction of the lateral is 90 degrees north, the whipstock would be set up with an extra 40 degrees of orientation locked into the device as measured from the orienting key locator. A whipstock has an angled face and is used to divert a drill bit or other tool away from the vertical plane at a particular angle. This allows the drill to create a new passage or lateral. When the lateral is complete the whipstock is removed leaving the packer and orientation key installed in the main wellbore.

The well may now be completed with pressure bearing tubing to allow production to begin. According to one preferred method feature of the invention, one possibility is to utilise the orientation key so that a Flow Control Nipple set up with the same criteria as the whipstock with a suitably large and appropriately positioned window may coincide, orientate and lie adjacent to the lateral. (See FIG. 3). This control device, if fitted with a wireline retrievable insert, would allow large diameter access to the lateral with the insert removed. However, wireline or other tools lowered into the wellbore would still bypass the lateral and would find their way down the main bore. In order to direct tools into the lateral, a diverter or re-entry guide (RG), is lowered into the nipple and is engaged with the orientation plate therein. This will orient the re-entry guide to the nipple window and the lateral bore such as to direct subsequent tools to be deployed into the lateral. Instruments, logging tools, plugs and other devices may be deployed in the lateral on wireline or coiled tubing to improve the efficiency of the well. Following completion of the lateral intervention, the RG is removed with wireline and the insert re-installed. The well may now be produced.

An alternative preferred method feature of the invention would be use of the device as shown in FIG. 5. This is commonly called a 'Y' piece and allows a retrievable flow control device to be hung from the short leg of the Y. The main bore allows production from zones situated below. Prior to retrieval of the flow control insert, a diverter device would be set. Subsequent tools introduced into the wellbore would be diverted into the lateral leg of the 'Y' and would again be diverted by the bottom shoulder of the lower portion of the main bore nipple into the lateral. Instruments, logging tools, plugs and other devices may be deployed into the lateral on wireline or coil tubing. Following complete of the lateral intervention, the diverter is removed and the flow control insert re-installed. The well may now be produced.

Improvements to the method may include the addition of electronic or other sondes for the purpose of data acquisition. This may take the form of pressure, temperature, flow measurement, scale formation, ph measurement and others. Sondes may be included below the flow control device (See FIG. 5) and may be memory type or connected to surface for real time readout. Any number of lateral branches may benefit from the method as previously described, limited only by the access diameter immediately above the junction or through the lower orientation packer. Additionally, it is envisaged that additional devices may be lowered some way down a lateral but still be coupled to the flow control device (FIG. 5). This may allow isolation of the lateral remotely from the main bore or perhaps monitoring equipment to be deployed further along the lateral and nearer the oil bearing formation.

Other improvements may include a bore through the diverter or re-entry guide to prevent differential sticking upon retrieval due to pressure differences between the lateral and main bore, bottom or otherwise locating shoulders for the diverter or re-entry guide to rest upon and inclusion of a mechanical window or other profile to provide a means of retrieval of the diverter or re-entry guide which will allow the top retrieval profile to be omitted thus allowing a greater through bore and larger diameter access to the lateral.

It will also be possible for the said method to operate with an isolation sleeve replacing the flow control valve. This sleeve will "blank off" the lateral and may be used in lieu of hydraulically operated valves. Flow from the lateral will be prevented but may be re-established upon removal of the sleeve.

We claim:

1. A system for controlling entry from a main bore of a casing into a lateral bore of a producing well which incorporates means for surface-actuated flow control in the lateral bore, and said system comprising:

a) a flow control means which can be removed when entry to the lateral bore is required, said flow control means having an internal passage allowing upward flow of produced fluid from the main bore and through said passage;

b) a locating nipple adapted to be mounted on the casing adjacent to the lateral bore, said nipple engaging with the flow control means to locate the latter in the casing when the flow control means is located in the well; and c) diverter means engageable with and orientable relative to the nipple and operative to guide entry to the lateral bore from above the nipple following removal of said flow control means.

2. A system according to claim 1, in which the flow control means defines a passage of sufficient size for upward movement of produced fluids, while still retaining said diverter means.

3. A system according to claim 1, in which the diverter means is a removable diverter means.

4. A system according to claim 1, in which the operation of the flow control means is controlled via one or more of a hydraulic control line; an electronic control line; and a fibre optic cable.

5. A method for controlling entry from a main bore of a casing into a lateral bore of a producing well which incorporates (i) means for surface-actuated flow control in the lateral bore and (ii) a flow control means located in the casing adjacent to the lateral bore, and said method comprising the steps of:

a) removing the flow control means when entry to the lateral bore is required, said flow control means having an internal passage allowing upward flow of produced fluid from the main bore and through said passage;

b) providing a locating nipple on the casing adjacent to the lateral bore and which engages with the flow control means to locate the latter; and d) providing diverter means in the casing which engages with and is orientable relative to the nipple and operates to guide entry to the lateral bore from above the nipple following removal of said flow control means.

* * * * *